United States Patent [19]

Cha

[11] 4,086,962

[45] May 2, 1978

[54] DECREASING HYDROGEN SULFIDE CONCENTRATION OF A GAS

[75] Inventor: Chang Yul Cha, Bakersfield, Calif.

[73] Assignee: Occidental Oil Shale, Inc., Grand Junction, Colo.

[21] Appl. No.: 780,924

[22] Filed: Mar. 24, 1977

[51] Int. Cl.[2] ..... E21B 43/24; E21B 43/26; E21C 41/10; B01J 8/02

[52] U.S. Cl. ..... 166/259; 166/266; 166/270; 299/2; 423/224; 423/244

[58] Field of Search ..... 166/244 C, 251, 256, 166/259, 261, 265, 266, 270; 299/2; 48/197 R; 208/11 R; 423/224, 230, 242, 244

[56] References Cited

U.S. PATENT DOCUMENTS

| | | | |
|---|---|---|---|
| 1,479,852 | 1/1924 | Engelhardt | 423/224 |
| 2,581,135 | 1/1952 | Odell | 423/224 |
| 2,812,288 | 11/1957 | Lankford et al. | 208/11 R X |
| 3,072,187 | 1/1963 | Carr | 166/261 X |
| 3,454,958 | 7/1969 | Parker | 166/256 |
| 3,548,938 | 12/1970 | Parker | 166/256 |
| 3,551,093 | 12/1970 | Myers | 423/244 |
| 3,578,080 | 5/1971 | Closmann | 166/259 X |
| 3,661,423 | 5/1972 | Garret | 299/2 |
| 4,005,752 | 2/1977 | Cha | 166/261 X |
| 4,014,575 | 3/1977 | French et al. | 166/256 |

*Primary Examiner*—Stephen J. Novosad
*Assistant Examiner*—George A. Suchfield
*Attorney, Agent, or Firm*—Christie, Parker & Hale

[57] ABSTRACT

The hydrogen sulfide concentration and total sulfur concentration of a gas of relatively higher hydrogen sulfide and total sulfur concentration are reduced by combining hydrogen sulfide in the gas with oxygen in the presence of a fragmented permeable mass of particles containing oil shale treated to remove organic materials to yield a gas with relatively lower hydrogen sulfide and total sulfur concentration for withdrawal from the fragmented permeable mass.

14 Claims, 4 Drawing Figures

Figure 1:
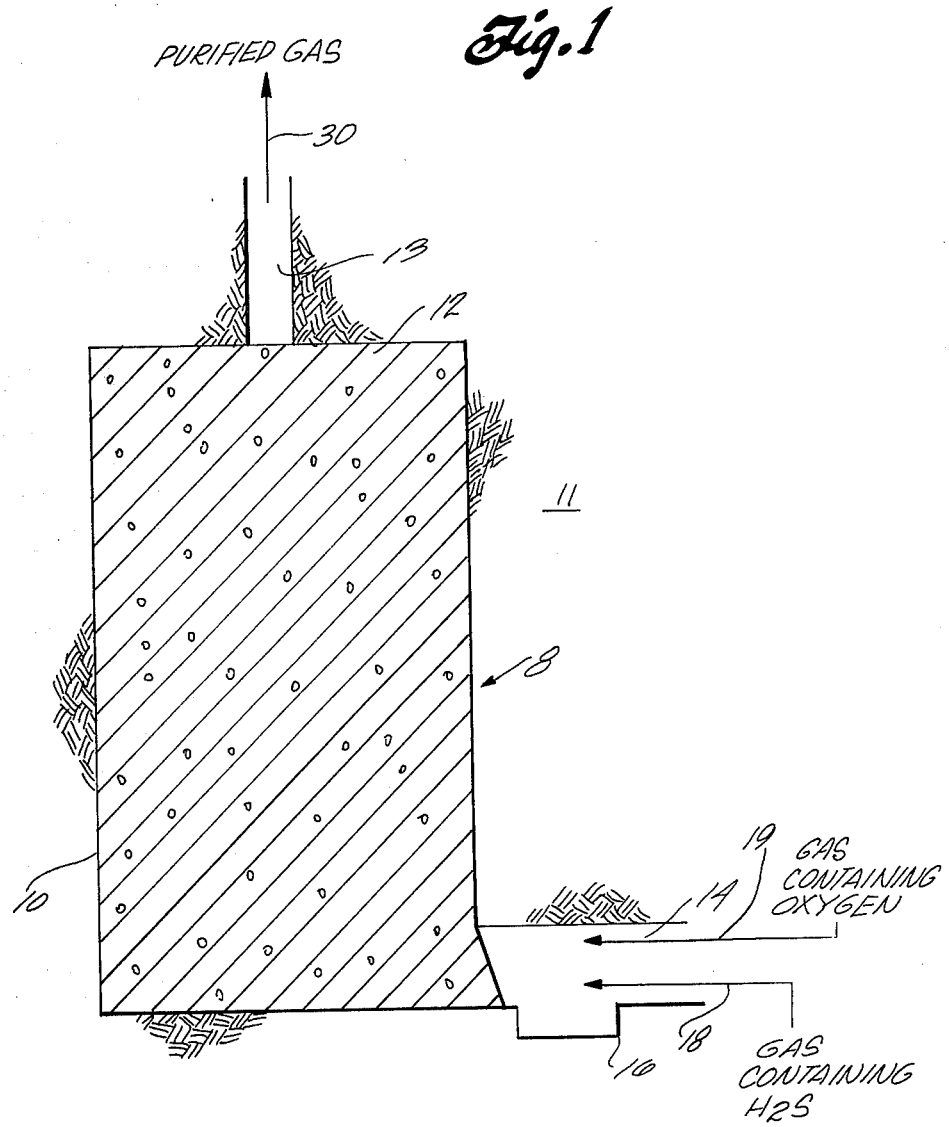

PURIFIED GAS
30
13
12
11
8
10
19
GAS CONTAINING OXYGEN
14
18
16
GAS CONTAINING H2S

TO VENT 122
133
113
118
114
120
121
115
107
108
117
116
119
106
106
105
105
109
110
$H_2S$ IN $N_2$
AIR
$N_2$
101
102
103
104
FUEL IN $N_2$

500°F

R ((KG H2S/KG SHALE)/SEC)
x 10-7
1
2
3
4
5
A (KG H2S/KG SHALE)
5
15
25
35 x10-3

DECREASING HYDROGEN SULFIDE CONCENTRATION OF A GAS

CROSS-REFERENCES

This application is related to U.S. patent application Ser. No. 780,927, filed on respectively entitled Oxidizing Hydrogen Sulfide, and filed by Leslie E. Compton; U.S. patent application Ser. No. 780,926, filed on Mar. 24, 1977, entitled Low Temperature Oxidation of Hydrogen Sulfide in the Presence of Oil Shale, and filed by Leslie E. Compton and William H. Rowan; and U.S. patent application Ser. No. 780,926, filed on Mar. 24, 1977 entitled Removing Hydrogen Sulfide From A Gas, and filed by Leslie E. Compton. Each of these three patent applications is incorporated herein by reference.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit interspersed with layers containing an organic polymer called "kerogen", which upon heating decomposes to produce liquid and gaseous products. It is the formation containing kerogen that is called "oil shale" herein, and the liquid product is called "shale oil". A number of methods have been developed for processing the oil shale which involve either first mining the kerogen bearing shale and processing the shale on the surface, or processing the shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972, to Donald E. Garrett, assigned to the assignee of this application and incorporated herein by reference. This patent describes in situ recovery of liquid and gaseous carbonaceous materials from a subterranean formation containing oil shale by fragmenting such formation to form a stationary, fragmented, permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producting "retorted oil shale".

One method of supplying hot retorting gases used for converting kerogen contained in the oil shale, as described in U.S. Pat. No. 3,661,423, includes establishment of a combustion zone in the retort and movement of an oxygen supplying gaseous feed mixture downwardly into the combustion zone as a gaseous combustion zone feed to advance the combustion zone downwardly through the retort. In the combustion zone oxygen in the gaseous feed mixture is depleted by reaction with hot carbonaceous materials to produce heat and a combustion gas. By the continued introduction of the oxygen supplying gaseous feed mixture downwardly into the combustion zone, the combustion zone is advanced downwardly through the retort.

The combustion gas and the portion of the gaseous feed mixture which does not take part in the combustion process pass through the retort on the advancing side of the combustion zone to heat the oil shale in a retorting zone to a temperature sufficient to produce kerogen decomposition, called retorting, in the oil shale to gaseous and liquid products and a residue product of solid carbonaceous material.

The liquid products and gaseous products are cooled by the cooler oil shale fragments in the retort on the advancing side of the retorting zone. The liquid carbonaceous products, together with water produced in or added to the retort, are collected at the bottom of the retort. An off gas containing combustion gas generated in the combustion zone, product gas produced in the retorting zone, gas from carbonate decomposition, and gaseous feed mixture which does not take part in the combustion process are also withdrawn at the bottom of the retort.

The off gas, which contains nitrogen, hydrogen, carbon monoxide, carbon dioxide, methane and other hydrocarbons, water vapor, and hydrogen sulfide, can be used as a fuel or otherwise disposed of, but should first be purged of the hydrogen sulfide, which is a pollutant. The hydrogen sulfide, which can be present in the off gas at concentrations in the range of 1500 to 3000 parts per million (ppm) by volume, is generated from naturally occurring sulfur compounds in oil shale during the heating and combustion in the in situ oil shale retort.

Hydrogen sulfide is an extremely toxic gas with a toxicity greater than that of hydrogen cyanide. It also possesses a powerful, objectionable odor with a threshold for human smell of about 0.0003 ppm. For these reasons emission standards for hydrogen sulfide have been established in many States, including States having oil shale deposits. Thus various processes for the removal of hydrogen sulfide from gases such as off gas from oil shale retorting have been devised. These processes generally involve absorption of hydrogen sulfide into a liquid such as alkanolamine or high temperature liquid carbonate solution, absorption of hydrogen sulfide onto a solid such as iron oxide pellets, and catalytic or noncatalytic oxidation of hydrogen sulfide to sulfur and/or sulfur dioxide such as in the Claus process.

A problem with absorption and adsorption processes is that the agent used for absorbing or adsorbing must, after use, be chemically regenerated or disposed of and replaced. Either of these alternatives can be expensive. A problem with noncatalytic oxidation is that high temperatures are required which may result in oxidation of the hydrocarbon and carbon monoxide constituents of the off gas, thereby substantially reducing the heating value of the off gas. A problem with catalytic oxidation is that the catalyst eventually becomes poisoned, thereby exhibiting reduced activity, and must then either be chemically regenerated or disposed of and replaced.

Thus, there is a need for an economical method for removing hydrogen sulfide from a gas stream, such as the off gas from an in situ oil shale retort, where the method does not substantially reduce the heating value of the gas stream.

SUMMARY OF THE INVENTION

According to the method of this invention the hydrogen sulfide concentration of a gas is reduced by introducing a gas containing a first, relatively higher hydrogen sulfide concentration to a fragmented permeable mass of particles containing oil shale treated to remove organic materials. Hydrogen sulfide in the gas is reacted in the presence of the oil shale to yield gas containing a second, relatively lower hydrogen sulfide concentration. The oil shale promotes the oxidation of the hydrogen sulfide. Such gas with relatively lower hydrogen sulfide concentration is withdrawn from the fragmented permeable mass of oil shale.

The gas containing a relatively higher hydrogen sulfide concentration can be reacted or combined with oxygen to form sulfur and oxygen bearing compounds in the presence of a fragmented permeable mass of particles containing oil shale treated to remove organic materials, where at least a portion of the treated oil shale contains alkaline earth metal oxides for combining with the formed sulfur and oxygen bearing compounds. Because of combination of sulfur and oxygen bearing compounds with alkaline earth metal oxides, a gas with a second, relatively lower hydrogen sulfide and total sulfur concentration can be withdrawn from the fragmented mass.

This method is effective for reducing the hydrogen sulfide concentration of off gas from an in situ oil shale retort. When gas containing fuel value components such as off gas from an in situ oil shale retort is the gas containing relatively higher hydrogen sulfide concentration, preferably oil shale contacted by the fuel value components is at a temperature less than the spontaneous ignition temperature of the fuel value components at the conditions at which the oil shale is contacted by the fuel value components.

DRAWINGS

Figure 2:
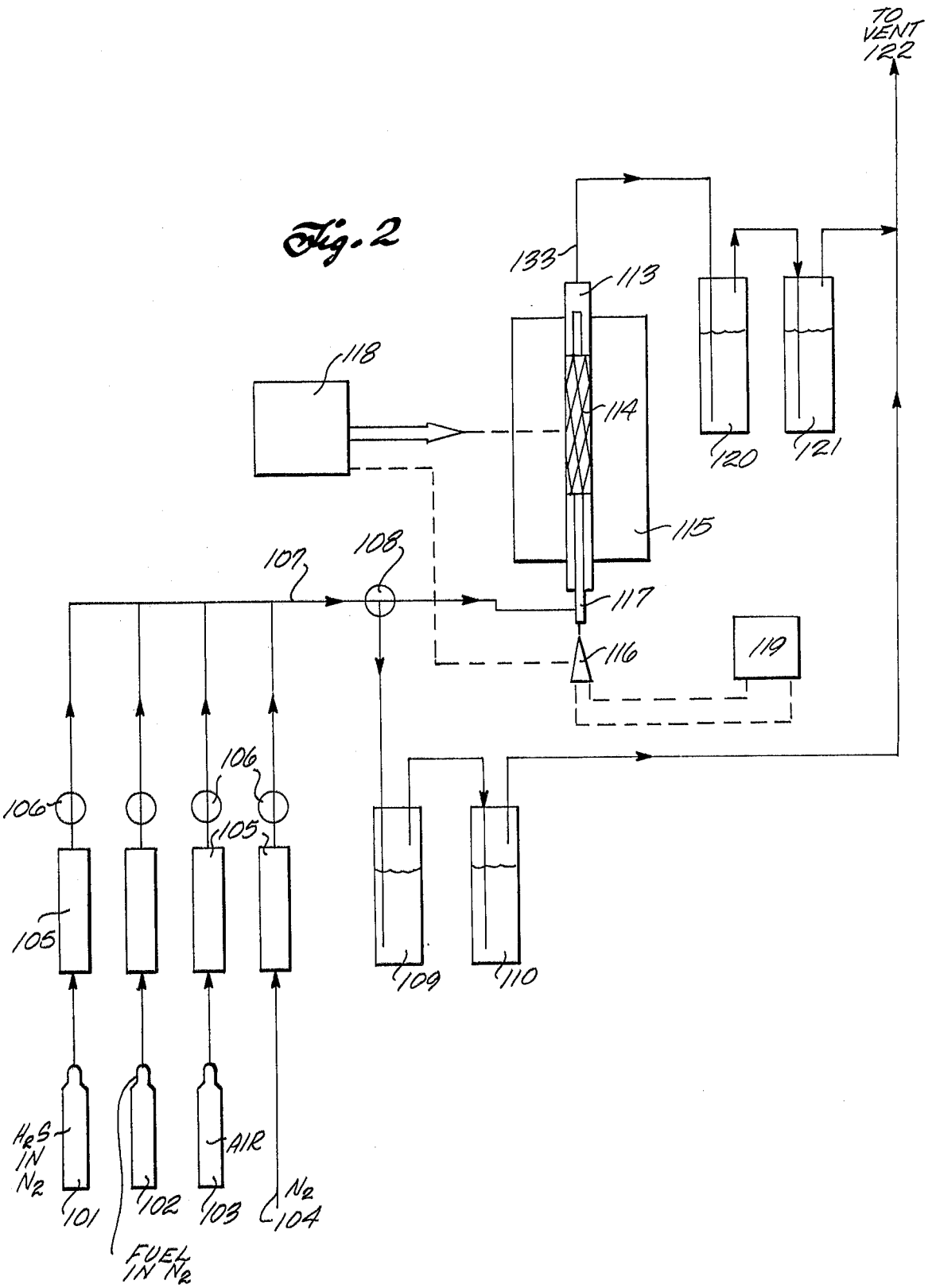
Figure 3:
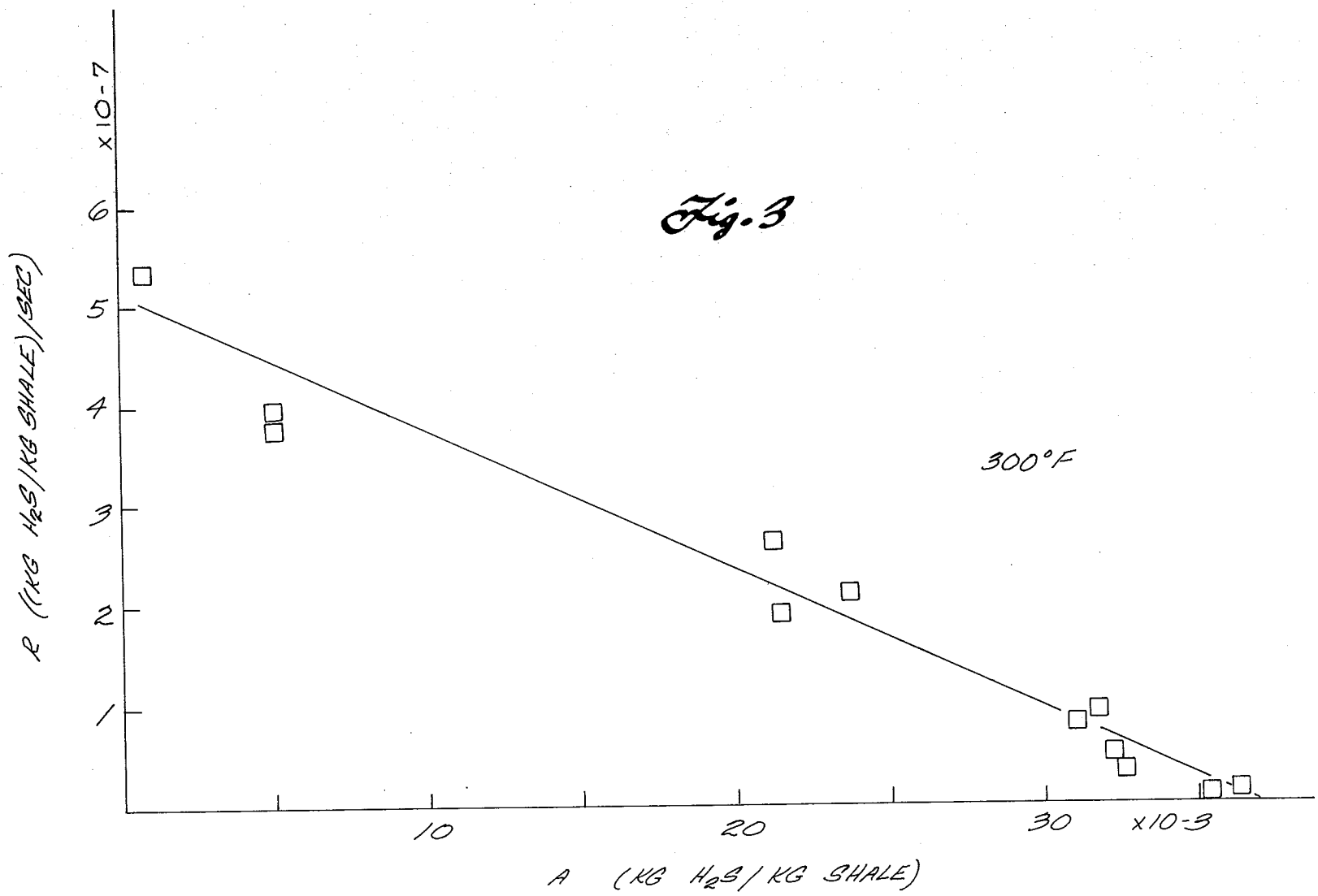
Figure 4:
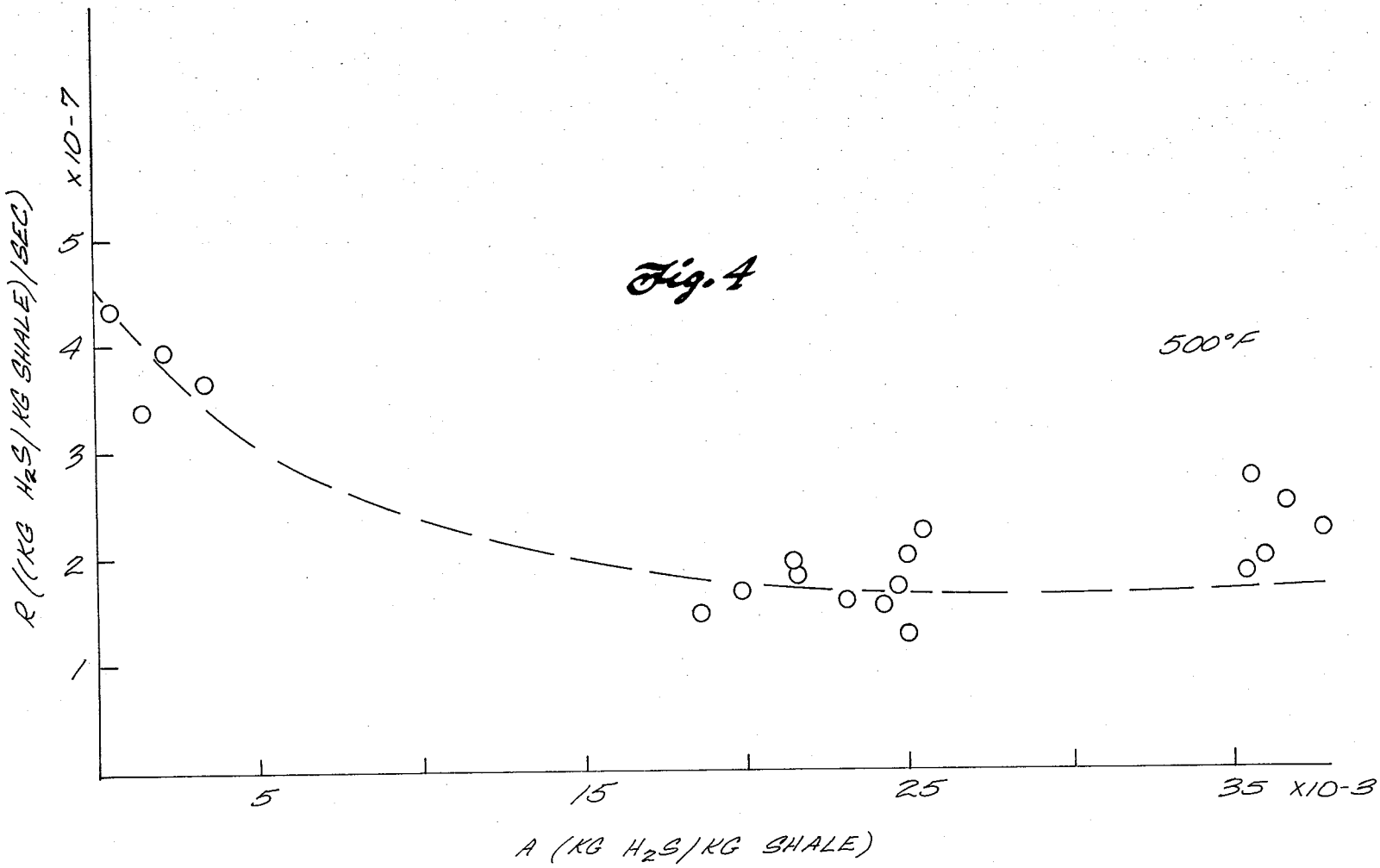

These and other features, aspects and advantages of the present invention will become more apparent with respect to the following description, appended claims and accompanying drawings where:

FIG. 1 schematically represents in vertical cross section an in situ oil shale retort containing combusted oil shale being used for decreasing the hydrogen sulfide concentration of a gas stream;

FIG. 2 schematically represents apparatus used for demonstrating the efficacy of the method of this invention; and FIGS. 3 and 4 present the results of tests conducted to demonstrate the efficacy of the method of the invention.

DESCRIPTION

Referring to FIG. 1, in an embodiment of this invention, an already retorted in situ oil shale retort 8 is in the form of a cavity 10 formed in an unfragmented subterranean formation 11 containing oil shale. The cavity contains an explosively expanded and fragmented permeable mass 12 of formation particles. The cavity can be created simultaneously with fragmentation of the mass of formation particles 12 by blasting by any of a variety of techniques. A method of forming an in situ oil retort is described in U.S. Pat. No. 3,661,423. A variety of other techniques can also be used.

A conduit 13 communicates with the top of the fragmented mass of formation particles. During the retorting operation of the retort 8, a combustion zone is established in the retort and advanced by introducing a gaseous feed containing an oxygen supplying gas, such as air or air mixed with other gases, into the in situ oil shale retort through the conduit 13. As the gaseous feed is introduced to the retort, oxygen oxidizes carbonaceous material in the oil shale to produce combusted oil shale and combustion gas. Heat from the exothermic oxidation reactions carried by flowing gases advances the combustion zone downwardly through the fragmented mass of particles.

Combustion gas produced in the combustion zone, any unreacted portion of the oxygen supplying gaseous feed and gases from carbonate decomposition are passed through the fragmented mass of particles on the advancing side of the combustion zone to establish a retorting zone on the advancing side of the combustion zone. Kerogen in the oil shale is retorted in the retorting zone to yield retorted oil shale and liquid and gaseous products including hydrocarbons.

There is a drift 14 in communication with the bottom of the retort. The drift contains a sump 16 in which liquid products are collected to be withdrawn for further processing. An off gas containing gaseous products, combustion gas, gases from carbonate decomposition, and any unreacted portion of the gaseous combustion zone feed is also withdrawn from the in situ oil shale retort 8 by way of the drift 14. The off gas can contain large amounts of nitrogen with lesser amounts of hydrogen, carbon monoxide, carbon dioxide, methane and higher hydrocarbons, water vapor and sulfur compounds such as hydrogen sulfide. The off gas also can contain particulates and hydrocarbon containing aerosols. It is desirable to remove at least a portion of the hydrogen sulfide from the off gas so the off gas can be used as fuel gas for power generation in a work engine such as a gas turbine, or if the off gas is flared, to limit the sulfurous emission.

At the end of retorting operations at least part of the oil shale in the retort 8 is at an elevated temperature which can be in excess of 1000° F. The hottest region of the retort is often near the bottom, and a somewhat cooler region is at the top due to continual cooling by gaseous feed containing oxygen during retorting and conduction of heat to adjacent shale. The oil shale in the retort 8 gradually cools toward ambient temperature when retorting and combustion are complete.

The retort illustrated in FIG. 1 has had retorting and combustion operations completed and contains a fragmented permeable mass of formation particles containing combusted oil shale. As used herein the term "retorted oil shale" refers to oil shale heated to sufficient temperature to decompose kerogen in an environment substantially free of free oxygen so as to leave a solid carbonaceous residue. The term "combusted oil shale" refers to oil shale of reduced carbon content due to oxidation by a gas containing free oxygen. The term "treated oil shale" refers to oil shale treated to remove organic materials and includes retorted and/or combusted oil shale. An individual particle containing oil shale can have a core of retorted oil shale and an outer "shell" of combusted oil shale. Such can occur when oxygen has diffused only partly way through the particle during the time it is at an elevated temperature and in contact with an oxygen supplying gas.

Oil shale contains large quantities of alkaline earth metal carbonates, principally calcium and magnesium carbonates, which during retorting and combustion are at least partly calcined to produce alkaline earth metal oxides. Thus combusted oil shale particles in the retort 8 can contain approximately 20 to 30% calcium oxide and 5 to 10% magnesium oxide, with smaller quantities of less reactive oxides present.

A process gas stream 18 containing hydrogen sulfide, such as off gas from an active oil shale retort, and a gas stream 19 containing oxygen, such as air, are introduced concurrently through the drift 14 to the already treated retort 8. There is sufficient differential pressure between the top and bottom of the retort to cause the gas streams to flow through the drift 14, which is in communication with the bottom of the retort, and upwardly as one combined gas stream through the retort 8 to be withdrawn from the retort through the conduit 13, which is in communication with the upper boundary of the fragmented mass of treated oil shale particles in the retort 8. For economy, the conduit used for introducing oxygen supplying gaseous feed to the retort 8 during the retorting operation is utilized to withdraw a gas 30 of reduced hydrogen sulfide concentration from the retort. Similarly, the drift 14 used for withdrawing off gas from the retort 8 during the retorting operation is utilized for introducing the gas streams 18, 19 to the retort. The gas 30 has a relatively lower hydrogen sulfide and total sulfur concentration than the hydrogen sulfide containing gas 18 introduced into the retort 8.

When the hydrogen sulfide containing gas is off gas from an active oil shale retort, oil aerosols and/or particulates which can be contained in the off gas can be removed from the off gas prior to introduction into the retort. This is done to prevent deposition of oil and/or particulates on the fragmented mass of oil shale particles in the retort, which can reduce the activity of the particles in removing hydrogen sulfide from the off gas.

As the hydrogen sulfide containing gas stream 18 and the oxygen containing gas stream 19 pass through the retort, hydrogen sulfide is oxidized to sulfur and oxygen bearing compounds, including sulfur dioxide. Oxidation of hydrogen sulfide in contact with treated oil shale has been demonstrated to occur at an appreciable rate even at temperatures as low as 75° F. This result is surprising because hydrogen sulfide is not oxidized at an appreciable rate at temperatures less than its spontaneous ignition temperature without use of a catalyst. It was not expected that oil shale would promote the oxidation of hydrogen sulfide.

The hydrogen sulfide containing gas 18 can contain fuel value components such as when the gas is off gas from an in situ oil shale retort. Off gas from an in situ oil shale retort can contain fuel value components such as hydrogen, methane and other hydrocarbons, and carbon monoxide. To avoid oxidation of such fuel value components, preferably the formation particles contacted by the fuel value components are at a temperature less than their spontaneous ignition temperature. The spontaneous ignition temperature of the fuel value components is dependent upon the conditions at which the formation particles are contacted by the fuel value components, i.e. the spontaneous ignition temperature of fuel value components is dependent upon such process parameters as the total pressure and the partial pressure of oxygen and the fuel value components in the retort.

The sulfur dioxide and sulfur produced from the reaction of oxygen and hydrogen sulfide can combine with constituents of the oil shale to yield solid sulfur-containing materials such as sulfites and pyrites. For example, as the gases containing sulfur bearing compounds pass through the retort, oxides of sulfur present in the gas can combine in the presence of water with the oxides of calcium and magnesium to form calcium and magnesium sulfites. Exemplary of the reactions which occur is the following reaction:

$$MO + SO_2 \rightarrow MSO_3$$

where M represents an alkaline earth metal. Water present in the retort is expected to enhance the rate of reaction of sulfur dioxide with alkaline earth metal oxides. Thus a substantial portion of the sulfur dioxide resulting from oxidation of hydrogen sulfide can be removed from the gas passing through the retort, especially at high temperatures for the mass of particles in the retort and at high molar ratios of alkaline earth metal oxides to sulfur dioxide. Therefore, when an oil shale retort containing treated oil shale is used, not only can the hydrogen sulfide content of a gas stream be reduced, but also the total concentration of sulfur compounds in the gas stream can be reduced.

As the temperature at which hydrogen sulfide containing gas is reacted with oxygen increases, the rate at which hydrogen sulfide contained in the gas stream 18 is converted to sulfur bearing compounds other than hydrogen sulfide increases, all other process conditions maintained constant. Also, while the direct reaction between sulfur dioxide and calcium or magnesium oxide to form the sulfite occurs slowly at ambient temperature, at temperatures above 1000° F short reaction times occur. When high temperatures are desire to achieve high rates of conversion of the hydrogen sulfide to sulfur bearing compounds and quick reaction between the formed sulfur bearing compounds and alkaline earth metal oxides, the heat for increasing input gas temperature can be at least partly obtained from the sensible heat remaining in the oil shale retort 8.

The maximum temperature for combining oxygen with the hydrogen sulfide containing gas in the presence of oil shale is the fusion temperature of oil shale, which is about 2100° F. At temperatures up to about 1000° F, the reaction of sulfur dioxide with alkaline earth metal oxides proceeds to completion, but at a slow rate. In addition, the rate of oxidation of hydrogen sulfide to sulfur and oxygen bearing compounds decreases as temperatures decrease.

It has been found that the lower the temperature at which hydrogen sulfide and oxygen are reacted, the higher the ratio of sulfur to sulfur dioxide at least initially produced by the oxidation reaction. At temperatures less than about 300° F, even at molar ratios of oxygen to hydrogen sulfide greater than 3:2, over 90% of the hydrogen sulfide is at least initially oxidized to form elemental sulfur. Even at temperatures as high as 450° F, over half of the hydrogen sulfide oxidized is at least initially oxidized to elemental sulfur.

Thus, removal of hydrogen sulfide from the gas stream 18 continues at lower rates until the temperature of the fragmented mass of retorted shale drops too low to provide adequate removal of the hydrogen sulfide. At temperatures approaching 300° F, the rate of conversion of hydrogen sulfide to other sulfur bearing compounds can be too slow and/or the flow rate of gas containing hydrogen sulfide can be too great to achieve adequate removal of hydrogen sulfide and sulfur in a single retort. The hydrogen sulfide containing gas 18 can then be passed with an oxygen containing gas through additional retorts in series and/or parallel containing oil shale treated to remove organic materials, or recirculated several times in a single retort to achieve maximum removal of hydrogen sulfide.

The hydrogen sulfide can be converted to other sulfur bearing compounds in the presence of oil shale at a desired temperature by passing the hydrogen sulfide containing gas 18 and oxygen containing gas 19 through a portion of the retort having the desired temperature.

As the amount of oxygen available to combine with hydrogen sulfide increases to provide a molar ratio of molecular oxygen to hydrogen sulfide of 3:2, the amount of sulfur dioxide formed increases. This can be understood with reference to the stoichiometry of the following reaction:

$$2H_2S + 3O_2 \rightarrow 2H_2O + 2SO_2.$$

Thus at a molar ratio of oxygen to hydrogen sulfide of 3:2, all the hydrogen sulfide in a hydrogen sulfide containing gas can be converted to sulfur dioxide. Thus preferably the hydrogen sulfide containing gas 18 is combined with sufficient oxygen so the molar ratio of molecular oxygen to hydrogen sulfide is at least about 3:2.

However, as the amount of oxygen available to combine with hydrogen sulfide increases, the likelihood of oxidation of other constituents of the hydrogen sulfide containing gas having fuel value increases. Therefore preferably the amount of oxygen combined with the hydrogen sulfide containing gas provides a molecular oxygen to hydrogen sulfide molar ratio not appreciably greater than 3:2, and more preferably, there is provided a molar ratio of about 3:2.

It has been found that proportion of hydrogen sulfide converted to other sulfur bearing compounds by reaction with oxygen in the presence of oil shale can gradually decrease as the oil shale is exposed to hydrogen sulfide. However, it appears that the conversion proportion asymptotically approaches a constant effective level.

Preferably there is a large stoichiometric excess of alkaline earth metal oxides in the combusted oil shale particles in the retort 8 relative to the sulfur bearing reaction products formed from the hydrogen sulfide containing gas 18. However, as the combusted oil shale particles in the retort 8 are used to remove sulfur bearing reaction products such as sulfur dioxide, the amount of alkaline earth metal oxides available for removing sulfur bearing reaction products decreases. In addition, calcium sulfite precipitates on the surface of the oil shale particles and reduces the efficiency of sulfur bearing reaction product removal. When this occurs, it can be necessary to pass the hydrogen sulfide containing gas 18 through additional in situ retorts containing retorted and/or combusted oil shale or recirculate the gas several times through a single retort to achieve adequate removal of hydrogen sulfide. When there is no longer a stoichiometric excess of alkaline earth metal oxides relative to the sulfur and oxygen bearing reaction products, such as sulfur dioxide formed, the hydrogen sulfide containing gas can be diverted to another retort containing oil shale particles treated to remove organic material.

Generally, sufficient alkaline earth metal oxides are present in a retort to remove sulfur dioxide formed from oxidation of hydrogen sulfide in off gas generated from retorting oil shale in a retort of comparable size. For example, retorting one ton of oil shale particles can yield 750 pounds of alkaline earth metal oxides and 18,000 standard cubic feet of off gas containing up to 0.17% by weight of hydrogen sulfide. Thus, for each mole of hydrogen sulfide produced in a retort, there are available over 300 moles of alkaline earth metal oxides in the retorted oil shale to remove sulfur and oxygen bearing products formed from oxidation of the hydrogen sulfide. Thus, when removing hydrogen sulfide from off gas generated during oil shale retorting, there is a large stoichiometric excess of alkaline earth metal oxides available. Therefore, the presence of calcium sulfite precipitates on the surfaces of the oil shale particles has a limited effect on removal of sulfur and oxygen bearing reaction products and at least the major part of the sulfur dioxide is oxidized off gas from an active in situ retort can be removed with retorted oil shale particles.

The hydrogen sulfide containing gas and oxygen containing gas can be introduced separately into the retort, or can be substantially homogeneously mixed prior to introduction into the retort. Mixing can be accomplished by any of a number of methods. Mixing can be effected with devices such as jet mixers, injectors, fans and the like.

The hydrogen sulfide containing gas 18 can inherently contain sufficient oxygen that an oxygen containing gas is not required. For example, off gas from an in situ oil shale retort can contain 0.2% by volume oxygen and 0.16% by volume hydrogen sulfide. Thus off gas can inherently contain sufficient oxygen to oxidize 83% of the hydrogen sulfide contained therein to sulfur dioxide and water.

Although FIG. 1 shows hydrogen sulfide and oxygen containing gas reacting in the presence of oil shale which was treated to remove organic materials by combustion, it has been found that hydrogen sulfide can be removed from gas streams by oxidizing the hydrogen sulfide in the presence of retorted oil shale. Thus this invention contemplates combining hydrogen sulfide with oxygen in the presence of either retorted and/or combusted oil shale. However, combusted oil shale has been found to be more effective in promoting oxidation of hydrogen sulfide than retorted oil shale.

Preferably the hydrogen sulfide containing gas and the oxygen containing gas are introduced to the hottest portion of the fragmented permeable mass in the retort to minimize pressure drop through the retort and the cost of passing gas through the retort. By introducing the gases to the hottest portion of the retort, heat is transferred by the flowing gases to the cooler portions of the retort, with the result that the fragmented permeable mass eventually has a substantially uniform temperature gradient, and no hot spot, with the temperature decreasing in the direction of movement of the gases. This results in reduced pressure drop across the retort because the volumetric flow rate of the gases through the retort decreases as the temperature of the fragmented mass decreases. Also the void fraction of the fragmented permeable mass increases due to thermal contraction of the formation particles as the mass of particles cools. Thus the cross sectional area available for flow of gases through the retort increases.

Therefore, as shown in FIG. 1, when a fragmented permeable mass in an in situ oil shale retort is retorted from top to bottom, preferably the hydrogen sulfide containing gas and the oxygen containing gas are introduced to the bottom of the retort, and purified gas is withdrawn from the top of the retort. An advantage of introducing the gas to the bottom of the retort, as shown in FIG. 1, is that off gas from the bottom of an adjacent active retort can be directly introduced to the bottom of the spent retort 8 without having to incur the capital and operating expenses of transferring the off gas to the surface.

The method of this invention has many advantages over prior art processes described above. By using oil shale to remove hydrogen sulfide from gas streams such as off gas from an in situ oil shale retort, the purchase of a hydrogen sulfide absorbent or adsorbent is avoided. Furthermore, when oil shale contained in an in situ oil shale is used, the oil shale remains in the ground, thereby eliminating disposal problems. In addition, a large stoichiometric excess of treated oil shale is available. Thus regeneration of oil shale, even if its activity is greatly reduced by poisoning, is unnecessary. A long residence time of the hydrogen sulfide containing gas and gaseous source of oxygen can be utilized to achieve high conversion. This permits operation at lower gas temperatures than are practiced in some commercial processes. Another advantage of the method of this invention is that while utilizing the sensible heat of retorted oil shale, which otherwise might not be used, heating of the hydrogen sulfide containing gas prior to removing the hydrogen sulfide can be avoided. Also, by combining hydrogen sulfide with oxygen at a sufficiently low temperature and low oxygen concentration, fuel value constituents of the oxygen containing gas such as hydrogen, carbon monoxide and hydrocarbons are not oxidized. Therefore, the fuel value of the hydrogen sulfide containing gas is not significantly reduced.

It will be understood that although the "oxygen containing gas" is ordinarily ambient air, other composition variations are included within the term. Thus, for example, if desired, pure oxygen or air augmented with additional oxygen can be used so that the partial pressure of oxygen is increased. Similarly, air can be diluted with an oxygen free gas such as nitrogen.

Tests demonstrating the method of the invention are described in a paper entitled "Hydrogen Sulfide Removal From Retort Off Gases Using Oil Shale" authored by Leslie E. Compton and William R. Rowan. This paper, which is filled herewith in the United States Patent and Trademark Office, is incorporated herein by reference.

The following examples demonstrate the efficacy of treated oil shale in promoting the oxidation of hydrogen sulfide to reduce the hydrogen sulfide and total sulfur concentration of a gas.

EXAMPLES 1 - 13

The apparatus for conducting Examples 1–13 is shown in FIG. 2. Bottled gas was provided in three tanks 101, 102, and 103. Tank 101 contained 1.2 volume percent hydrogen sulfide in nitrogen. Tank 2 contained 27 volume percent $CO_2$, 4.5 volume percent $CH_4$, 2.9 volume percent $H_2$, and 4.2 volume percent CO in nitrogen. This is about the same ratio as these gases are present in off gas from an oil shale retort. Tank 103 contained air. Dry nitrogen was provided from line 104.

Gases from tanks 101, 103 and line 104 were metered with flow meters 105 and control valves 106 and blended together to form 0.0464 cfm (cubic feet per minute) at 75° F of a gas mixture in line 107 containing 18 volume percent or 0.10 volume percent $H_2S$, and 71.9 volume percent nitrogen. The gas mixture in line 107 passed to a three way valve 108 where a portion was intermittently diverted to a first water trap 109, and then to a first sodium hydroxide trap 110 having a pH of 14. The first water trap 109 was used to determine the amount of hydrogen sulfide which dissolved in water at the gas compositions, flow rates, and trap configurations used. The first sodium hydroxide trap 110 was used to determine the inlet hydrogen sulfide concentration.

The gas mixture not diverted passed to a $\frac{7}{8}$ inch inner diameter quartz reactor 113 containing a bed 114 of oil shale particles. The temperature of the oil shale bed was maintained at a desired level with a single zone, one inch internal diameter electric furnace 115. Shale bed temperatures were scanned with a thermocouple probe 116 inserted in a thermo-well 117. The temperature in the bed was controlled by means of a temperature controller 118, and temperature was monitored with a temperature indicator 119.

Effluent gas from the shale bed passed via line 133 to a second set of water 120 and sodium hydroxide 121 traps, and then was vented through line 122 to a hood (not shown). Elemental sulfur formed by the oxidation of hydrogen sulfide departed in line 133.

The second water trap 120 served to remove sulfur dioxide from the reactor effluent and the second sodium hydroxide trap 121 removed unreacted hydrogen sulfide from the reactor effluent.

The sulfur content in the four traps was determined using a $KIO_3$ titration to a starch iodine end point. For the sodium hydroxide traps 110 and 121, the sample was acidified with hydrochloric acid prior to titration. The $SO_2$ concentration of the effluent gas as measured with the second water trap 120 was adjusted for the amount of $H_2S$ known to dissolve in the trap as determined with the first water trap 109.

For Examples 1–5, seventy grams of $-3 = 8$ mesh oil shale combusted at 1600° F with oxygen (SSI) were placed in the reactor. For Examples 6–9, seventy grams of oil shale combusted at 1200° F with oxygen (SSII) were used in the reactor. For Examples 10–13, seventy grams of 1 mm diameter glass beads were used in the reactor. The reactor temperature used for each example is listed in Table I. The traps were periodically sampled to determine the hydrogen sulfide content of the gas mixture 107 feed to the reactor and the hydrogen sulfide and the sulfur dioxide contents of the effluent from the reactor.

The percentage by weight of hydrogen sulfide removed from the feed, the percentage by weight of hydrogen sulfide converted to sulfur dioxide and the ratio of elemental sulfur to $SO_2$ produced from the $H_2S$ are presented in Table I for one, two, three and four hours after initiation of feed to the pyrolysis reactor, where the data are available. The values in Table I assume that all hydrogen sulfide in the gas mixture feed to the reactor which is not in the effluent as sulfur dioxide or hydrogen sulfide was converted to elemental sulfur. Because of the low hydrogen sulfide removal obtained with the glass beads, the ratio of sulfur to $SO_2$ production and the percentage converted to $SO_2$ were not calculated for Examples 10–13.

The results presented in Table I show that when the hydrogen sulfide contacted combusted oil shale in the presence of oxygen, a portion of the hydrogen sulfide was oxidized to sulfur dioxide and sulfur. However, at temperatures up to 500° F hydrogen sulfide was not oxidized by contacting glass beads in the presence of oxygen. The run at 650° F is above the spontaneous ignition temperature of hydrogen sulfide. The results presented in Table I also show that as the reactor temperature increased, hydrogen sulfide removal increased and the ratio of sulfur to sulfur dioxide formed by oxidation of the hydrogen sulfide decreased. The results also indicate that efficiency of hydrogen sulfide removal deteriorated with increased exposure to hydrogen sulfide.

A comparison of the results of Examples 1, 3, 4, and 5 to the results of Examples 6, 7, 8, and 9, respectively, indicates that SSI shale, which was combusted at 1200° F, is more effective than SSII shale, which was combusted at 1600° F, in promoting oxidation of hydrogen sulfide. This is believed done to sintering of oil shale at elevated temperatures such as 1600° F with resultant loss of porosity and number of active sites for promoting oxidation of hydrogen sulfide. Therefore preferably hydrogen sulfide in a gas is reacted with oxygen in the presence of oil shale combusted at a temperature of less than about 1600° F for maximum efficiency of removal of hydrogen sulfide from the gas.

EXAMPLES 14–16

Using the apparatus of FIG. 2, a reactor feed gas mixture having a composition by volume of 28% $CO_2$, 5% CO, 4.5% $CH_4$, 4.2% $H_2$, 0.10% $H_2S$, 0.5% $O_2$ and the balance $N_2$ was introduced to the reactor 114 at a rate of 0.0464 cfm at 75° F. The reactor contained 70 gram charges of combusted Colorado shale contaminated with waste water from an in situ oil shale retort for Example 14, the combusted Colorado Shale of Example 14 which was exposed to air at 900° F for three hours before use in the reactor for Example 15, and SSII type shale for Example 16. The percent hydrogen sulfide removal was determined using the method described for Examples 1–13 at 20, 60 and 100 minutes after initiation of feed to the reactor for all the examples, and at 140 minutes for Examples 14 and 15.

The results, which are presented in Table II, clearly show that treated oil shale was effective in removing hydrogen sulfide from the feed gas in the presence of oxygen. However, the efficacy of shale appears to be dependent on preparative history, with higher temperature treatment up to 1200° F prior to use resulting in a shale more effective in promoting oxidation of hydrogen sulfide, i.e. SSII which was oxygen cleaned at 1200° F prior to use performed best at oxidizing hydrogen sulfide.

It was noted that during runs 14 and 16 that no measurable amount of the carbon monoxide, methane, and hydrogen introduced into the quartz reactor was lost This indicates that oil shale can be used to effectively remove hydrogen sulfide from a gas stream containing components having fuel value without deleteriously affecting the fuel value of the gas stream.

EXAMPLES 17 - 18

Using the apparatus of FIG. 2, the reactor 114 was charged with seventy grams of −3 =8 mesh SSI type shale. A gaseous feed mixture 107 containing $N_2$, $CO_2$, CO, $CH_4$, $H_2$, and $H_2S$ in a volume ratio of about 64:28:5:4.5:4.2:0.1, respectively, was introduced to the reactor at a rate of 0.0464 cfm at 75° F. The volume ratio of oxygen to hydrogen sulfide was varied to determine the effect of this ratio on the percent hydrogen sulfide removed. For Example 17 the ratio of $0_2$ to $H_2S$ was 0.50, and for Example 18 the ratio was 4.6. The percent hydrogen sulfide removed was determined at 20 minutes, 40 minutes, 60 minutes, and 80 minutes for both examples. The results, which are presented in Table III, indicate that at least initially an oxygen to hydrogen sulfide ratio less than the 3:2 ratio required for a stoichiometric reaction to form sulfur dioxide yields higher efficiency of hydrogen sulfide removal than a ratio significantly greater than the 3:2 ratio.

EXAMPLE 19

Off gas generated in a first in situ oil shale retort at a rate of 1046 SCFM containing a varying concentration of hydrogen sulfide in the range of from 1500 to 3000 ppm by volume hydrogen sulfide is combined with 23.5 SCFM of air (molar ratio of $0_2$ to $H_2S$ of 3:2 at 3000 ppm $H_2S$ content of the off gas). The combined gas stream is introduced into the bottom of a second in situ oil shale retort in the south/southwest portion of the Piceance Creek structural basin in Colorado. The second retort contains a fragmented permeable mass of particles containing combusted oil shale. The second retort was retorted from top to bottom. The horizontal cross-sectional area of the first and second retorts in 1055 square feet and both retorts are 113 feet high. Gas is withdrawn from the top of the retort. The withdrawn gas has a lower $H_2S$ concentration than the combined gas introducted to the retort.

EXAMPLES 20 and 21

In these two examples, hydrogen sulfide in off gas generated in an in situ oil shale retort in the south/southwest portion of the Piceance Creek structural basin in Colorado was oxidized in the presence of combusted oil shale in an experimental reactor. The experimental procedures and parameters were substantially the same as for Examples 1–13, except as noted below. The retort off gas containing hydrogen sulfide was a slip stream removed from a retort outlet line at the bottom of an in situ oil shale retort during retorting of oil shale therein. As such it was representative of off gas generated in the in situ oil shale retort. It is believed that the off gas contained water vapor. Entrained solids and aerosols larger than about $10^{-6}$ meter in diameter were removed upstream of the experimental reactor.

Hydrogen sulfide concentrations were determined as in Examples 1–13, with routine analytical backup by gas chromatography and lead salt absorbtion (Drager tubes). The concentration of hydrogen sulfide in the off gas at the reactor inlet varied between about 500 and 3500 parts per million due to changing process conditions. The average hydrogen sulfide concentration was about 2,500 ppm. The oxygen concentration of the gas introduced to the reactor varied between 10,000 and 60,000 ppm.

In Examples 20 and 21 144.7 grams of −3 +8 mesh oil shale combusted at 1600° F with oxygen were placed in the reactor. In Example 20, the reactor bed temperature was maintained between 312° and 345° F. In Example 21, the reactor bed temperature was maintained between 481° and 515° F.

Results of the tests of Examples 20 and 21 are presented in FIGS. 3 and 4, respectively. In these two figures, reaction rate, R, is plotted against the total amount of hydrogen sulfide reacted, A. The reaction rate, R, is defined as the average weight of hydrogen sulfide removed from the off gas per second per unit weight of shale in the reactor. Total hydrogen sulfide reacted, A, is defined as the total weight of hydrogen sulfide reacted per unit weight of shale in the reactor. FIGS. 3 and 4 indicate that oil shale can be used to promote the removal of at least about 3.5% of its own weight in hydrogen sulfide.

EXAMPLES 22–24

Tests were conducted to determine the effect of temperature on oxidizing fuel value components in off gas in the presence of combusted oil shale. A constant flow of gas at 6 SCFM per square foot of shale bed (superficial velocity) was introduced downwardly into an externally heated, forced down flow reactor. The shale was −3 +8 mesh combusted oil shale. The heat of combustion to liquid water of the gas was 62 BTU cubic foot. The shale bed was maintained at a temperature of 850° F in Example 22, 700° F in Example 23, and 600° F in Example 24. The inlet and outlet gas concentrations were determined with gas chromatography. The inlet gas contained hydrogen, methane, ethane, ethylene, $C_3$'s, $C_4$'s, $C_5$+, carbon monoxide, oxygen, and nitrogen. The proportions of carbon monoxide, carbon dioxide, hydrogen and nitrogen in the gas were controlled to approximate the composition of off gas from an in situ oil shale retort.

The inlet and outlet gas concentrations for each example are presented in Table IV. Gas not accounted for in Table IV is nitrogen.

The results presented in Table IV indicate that at temperatures less than about 650° F, and particularly at about 600° F, fuel value components of off gas are not oxidized in the presence of combusted oil shale and oxygen.

Although this invention has been described in considerable detail with reference to certain versions thereof, other versions of the invention are possible. Thus the spirit and scope of the appended claims should not necessarily be limited to the description of the versions contained herein.

TABLE II-continued

| Ex. | Reactor Charge | Reactor Temp. (° F.) | $H_2S$ Removal (%) Time (min.) 20 | 60 | 100 | 140 |
|---|---|---|---|---|---|---|
| 16 | SSII | 300 | 85 | 64 | 50 | — |

TABLE III

| Ex. | Reactor Charge | Reactor Temp. (° F.) | $O_2/H_2S$ Ratio | $H_2S$ Removal (%) Time (min.) 20 | 40 | 60 | 80 |
|---|---|---|---|---|---|---|---|
| 17 | SSI | 300 | 0.50 | 95 | 94 | 93 | 92 |
| 18 | SSI | 300 | 4.6 | 86 | 77 | 68 | 63 |

TABLE IV

| EX. | TEMP. ° F | SAMPLE POINT | GAS CONCENTRATIONS IN VOL. % $H_2$ | $CH_4$ | $C_2H_6$ | $C_2H_4$ | $C_3$ | $C_4$ | $C_5$+ | CO | $O_2$ |
|---|---|---|---|---|---|---|---|---|---|---|---|
| 22 | 850 | Inlet | 4.44 | 2.17 | 0.79 | 0.042 | 0.012 | 0.003 | 0.023 | 2.99 | 19.4 |
| | | Outlet | 0.06 | 0.000 | 0.004 | 0.029 | 0.003 | 0.002 | 0.019 | 0.233 | 8.6 |
| 23 | 700 | Inlet | 4.33 | 2.15 | 0.78 | 0.028 | 0.006 | 0.002 | 0.020 | 2.95 | 19.0 |
| | | Outlet | 0.044 | 0.044 | 0.003 | 0.026 | 0.006 | 0.002 | 0.020 | 1.05 | 9.5 |
| 24 | 600 | Inlet | 5.26 | 2.52 | 0.94 | — | — | — | — | 3.48 | 5.6 |
| | | Outlet | 5.23 | 2.46 | 0.94 | — | — | — | — | 3.49 | 5.6 |

What is claimed is:

1. A method for recovering gaseous products from a first in situ oil shale retort in a subterranean formation containing oil shale, said first in situ retort containing an explosively expanded and fragmented permeable mass of particles containing oil shale and having a combustion zone and a retorting zone advancing therethrough, the method comprising the steps of:

(a) introducing into the first in situ oil shale retort on the trailing side of the combustion zone a combustion zone feed comprising oxygen to advance the combustion zone through the fragmented mass of particles and produce combustion gas in the combustion zone;

(b) passing said combustion gas and any unreacted portion of the combustion zone feed through a retorting zone in the fragmented mass of particles on the advancing side of the combustion zone, wherein oil shale is retorted and gaseous products including hydrocarbons are produced;

TABLE I

| Ex. | Reactor Charge | Reactor Temp. ° F | $H_2S$ Removal (%) Time (Hrs.) 1 | 2 | 3 | 4 | Ratio of Sulfur to $SO_2$ Production Time (Hrs.) 1 | 2 | 3 | 4 | % $H_2S$ Converter to $SO_2$ Time (Hrs.) 1 | 2 | 3 | 4 |
|---|---|---|---|---|---|---|---|---|---|---|---|---|---|---|
| 1 | SSI | 75 | 20 | 8 | — | — | — | — | — | — | — | — | — | — |
| 2 | SSI | 200 | 43 | 33 | 26 | 22 | — | — | — | — | — | — | — | — |
| 3 | SSI | 300 | 63 | 47 | 33 | 24 | 9.5 | 10.8 | 7.3 | — | 6 | 4 | 4 | — |
| 4 | SSI | 400 | 88 | 68 | 57 | 52 | 4.5 | 4.2 | 4.2 | 3.7 | 16 | 13 | 11 | 11 |
| 5 | SSI | 500 | 99 | 95 | 95 | 93 | 0.74 | 0.22 | — | — | 57 | 78 | — | — |
| 6 | SSII | 75 | 12 | 26 | — | — | — | — | — | — | — | — | — | — |
| 7 | SSII | 300 | 65 | 51 | 44 | 40 | 9.8 | 7.5 | 6.3 | 5.7 | 6 | 6 | 6 | 6 |
| 8 | SSII | 400 | 100 | 80 | 73 | 70 | 3.3 | 3.0 | 3.1 | 3.4 | 23 | 20 | 18 | 16 |
| 9 | SSII | 500 | 100 | 100 | 100 | 100 | 0.35 | 0.22 | 0.20 | 0.18 | 74 | 82 | 83 | 85 |
| 10 | Glass Beads | 300 | 3 | — | — | — | — | — | — | — | — | — | — | — |
| 11 | Glass Beads | 400 | 0 | — | — | — | — | — | — | — | — | — | — | — |
| 12 | Glass Beads | 500 | 3 | — | — | — | — | — | — | — | — | — | — | — |
| 13 | Glass Beads | 650 | 48 | — | — | — | — | — | — | — | — | — | — | — |

TABLE II

| Ex. | Reactor Charge | Reactor Temp. (° F.) | $H_2S$ Removal (%) Time (min.) 20 | 60 | 100 | 140 |
|---|---|---|---|---|---|---|
| 14 | Combusted Colorado Shale | 300 | 58 | 37 | 27 | 22 |
| 15 | Combusted Colorado Shale exposed to air at 900° F for 3 hours | 300 | 67 | 47 | 40 | 35 |

(c) withdrawing a retort off gas comprising said gaseous products including hydrocarbons, combustion gas and any gaseous unreacted portions of the combustion zone feed from the first in situ oil shale retort from the advancing side of the retorting zone; and (d) reducing the hydrogen sulfide and total sulfur concentration of retort off gas from the first retort by the steps of:

(i) during a first period of time introducing a gaseous combustion zone feed containing oxygen into a combustion zone in a second in situ oil shale retort in a subterranean formation containing oil shale and including alkaline earth metal carbonates, said second in situ retort containing an explosively expanded and fragmented permeable mass of formation particles containing oil shale and alkaline earth metal carbonates wherein the gaseous combustion zone feed advances the combustion zone through the fragmented mass of particles and converts at least a portion of the alkaline earth metal carbonates to alkaline earth metal oxides and produces combusted oil shale particles; and thereafter (ii) during a second period of time introducing at least a portion of the retort off gas from the first retort into the second retort, introducing oxygen containing gas into the second retort for reacting oxygen in the oxygen containing gas with hydrogen sulfide in the retort off-gas in the presence of combusted oil shale in the second retort to form compounds containing sulfur and oxygen, wherein at least a portion of the formed compounds containing sulfur and oxygen combine with alkaline earth metal oxides contained in the second retort, wherein gas having a hydrogen sulfide and total sulfur concentration relatively lower than the hydrogen sulfide and total sulfur concentration of the off gas is produced, and withdrawing such gas with relatively lower hydrogen sulfide and total sulfur concentration from the second retort.

2. A method of decreasing hydrogen sulfide and total sulfur concentration of a gas comprising the steps of:

introducing a gas containing relatively higher hydrogen sulfide and total sulfur concentration to a fragmented permeable mass of oil shale, wherein at least a portion of the oil shale has been treated to remove organic material prior to introducing the gas to the oil shale;

reacting hydrogen sulfide in the gas with oxygen in the presence of the oil shale to yield gas having a hydrogen sulfide and total sulfur concentration relatively lower than the hydrogen sulfide and total sulfur concentration of the introduced gas; and withdrawing such gas with relatively lower hydrogen sulfide and total sulfur concentration from the fragmented permeable mass of oil shale.

3. The method of claim 2 in which the gas containing relatively higher hydrogen sulfide and total sulfur concentration contains fuel value components, and wherein oil shale contacted by the fuel value components is at a temperature less than the spontaneous ignition temperature of the fuel value components at the conditions at which the oil shale is contacted by the fuel value components.

4. A method for decreasing hydrogen sulfide and total sulfur concentration of off gas from an in situ oil shale retort, the off gas containing fuel value components, comprising the steps of:

forming sulfur and oxygen bearing compounds by combining the off gas with oxygen in the presence of a fragmented permeable mass of particles containing oil shale treated to remove organic materials, wherein at least a portion of the treated oil shale is at a temperature greater than about 300° F and at least a portion of the treated oil shale contains alkaline earth metal oxides for combining with the formed sulfur and oxygen bearing compounds, and wherein the treated oil shale contacted by the fuel value components is at a temperature less than the spontaneous ignition temperature of the fuel value components at the conditions at which the treated oil shale is contacted by the fuel value components.

5. The method of claim 4 in which the off gas is combined with at least about 3 moles of molecular oxygen per 2 moles of hydrogen sulfide contained therein.

6. The method of claim 4 wherein the fragmented permeable mass has a stoichiometric excess of alkaline earth metal oxides relative to the sulfur and oxygen bearing compounds formed by combining the hydrogen sulfide containing gas with oxygen.

7. A method for removing hydrogen sulfide from a gas stream comprising the steps of:

forming a first in situ oil shale retort in a subterranean formation containing oil shale, said first in situ retort containing a fragmented permeable mass of formation particles containing oil shale and alkaline earth metal carbonates;

producing combusted oil shale in the first retort by introducing a gaseous combustion zone feed comprising an oxygen supplying gas into a combustion zone in the fragmented mass for advancing the combustion zone through the fragmented mass of particles and producing combustion gas and combusted oil shale and converting at least a portion of the alkaline earth metal carbonates to corresponding alkaline earth metal oxides;

ending advancement of the combustion zone;

thereafter, contacting, in the presence of oxygen, formation particles at a temperature greater than about 300° F in the first in situ retort with a process gas with relatively higher hydrogen sulfide and total sulfur concentration to form compounds containing sulfur and oxygen, wherein at least a portion of the formed compounds containing sulfur and oxygen combine with alkaline earth metal oxides contained in the first retort to yield gas having a hydrogen sulfide and total sulfur concentration relatively lower than the hydrogen sulfide and total sulfur concentration of the process gas; and withdrawing such gas with relatively lower hydrogen sulfide and total sulfur concentration from the first in situ oil shale retort.

8. The method of claim 7 in which the gas containing relatively higher hydrogen sulfide concentration comprises off gas from a second in situ oil shale retort, the off gas containing fuel value components, and wherein the formation particles in the first retort contacted by the fuel value components in the off gas are at a temperature less than the spontaneous ignition temperature of the fuel value components at the conditions at which the formation particles are contacted by the fuel value components.

9. A method for decreasing hydrogen sulfide and total sulfur concentration of a gas stream comprising the step of passing a gas containing relatively higher hydrogen sulfide and total sulfur concentration through a first in situ oil shale retort containing an explosively fragmented permeable mass of combusted oil shale particles and including alkaline earth metal oxides, while concurrently introducing a source of oxygen into said first retort to combine therein with said hydrogen sulfide and alkaline earth metal oxides to form alkaline earth metal sulfites, whereby the gas after passing through the first retort is of relatively lower hydrogen sulfide and total sulfur concentration than the gas before passing through the first retort.

10. The method of claim 9 in which at least about 3 moles of molecular oxygen per 2 moles of hydrogen sulfide contained in the gas of relatively higher hydrogen sulfide and total sulfur concentration are introduced into the first retort.

11. The method of claim 9 in which the gas of relatively higher hydrogen sulfide concentration comprises off gas from a second oil shale retort, the off gas contains fuel value components, and wherein combusted oil shale particles in the first retort contacted by the fuel value components are at a temperature less than the spontaneous ignition temperature of the fuel value components at the conditions at which the particles are contacted by the fuel value components.

12. A method of decreasing hydrogen sulfide and total sulfur concentration of a gas comprising the steps of:

introducing a gas with a first hydrogen sulfide and total sulfur concentration to a fragmented permeable mass of oil shale, wherein at least a portion of the oil shale has been treated to remove organic material prior to introducing the gas to the oil shale;

reacting hydrogen sulfide in the gas with oxygen in the presence of the oil shale to yield gas having a second hydrogen sulfide and total sulfur concentration; and withdrawing such gas with the second hydrogen sulfide and total sulfur concentration from the fragmented permeable mass of oil shale, wherein the second hydrogen sulfide and total sulfur concentration is lower than the first hydrogen sulfide and total sulfur concentration.

13. A method for reducing the hydrogen sulfide concentration of an off gas from an in situ oil shale retort, the off gas containing hydrogen sulfide and water, comprising the steps of:

introducing the off gas to a fragmented permeable mass of oil shale treated to remove organic material prior to introducing the off gas to the fragmented mass;

reacting hydrogen sulfide in the off gas with oxygen in the presence of the oil shale to yield gas having a hydrogen sulfide concentration relatively lower than the hydrogen sulfide concentration of the off gas; and withdrawing such gas having relatively lower hydrogen sulfide concentration from the fragmented permeable mass of oil shale.

14. A method for reducing the hydrogen sulfide concentration of an off gas from an in situ oil shale retort, the off gas containing hydrogen sulfide, particulates, and hydrocarbon containing aerosols, comprising the steps of:

introducing the off gas to a fragmented permeable mass of oil shale treated to remove organic material prior to introducing the off gas to the fragmented mass;

reacting hydrogen sulfide in the off gas with oxygen in the presence of the oil shale to yield gas having a hydrogen sulfide concentration relatively lower than the hydrogen sulfide concentration of the off gas; and withdrawing such gas having relatively lower hydrogen sulfide concentration from the fragmented permeable mass of oil shale.

* * * * *

UNITED STATES PATENT AND TRADEMARK OFFICE

CERTIFICATE OF CORRECTION

PATENT NO. : 4,086,962

DATED : May 2, 1978

INVENTOR(S) : Chang Yul Cha

It is certified that error appears in the above-identified patent and that said Letters Patent are hereby corrected as shown below:

Column 1, line 7, change "respectively" to -- March 24, 1977 --;

Column 1, line 8, after ";" insert -- and --;

Column 1, line 9, "780,926" should read -- 780,928 --;

Column 1, line 12-15, delete "and U. S. Patent Application Serial Number 780,926 ..... ...filed by Leslie E. Compton";

Column 1, line 16, after "these" delete "three";

Column 1, line 53, "producting" should read -- producing --.

Column 2, line 18, "are" should read -- is -- .

Column 3, line 55, after "cavity" insert -- 10 --.

Column 8, line 11, "is" should read -- in --;

Column 8, line 64, after "and" delete "purified".

Column 9, line 41, "filled" should read -- filed --;

Column 9, line 53, after "Tank" change "2" to -- 102 --.

UNITED STATES PATENT AND TRADEMARK OFFICE

CERTIFICATE OF CORRECTION

PATENT NO. : 4,086,962

DATED : May 2, 1978

INVENTOR(S) : Chang Yul Cha

It is certified that error appears in the above-identified patent and that said Letters Patent are hereby corrected as shown below:

Column 9, line 63, "or" should read -- oxygen --.

Column 11, line 56, "=" should read -- + --.

Column 12, line 19, "in" should read -- is --;

Column 12, line 21, after "the" (second occurrence) insert -- second --;

Column 12, line 23, after "the" insert -- second --.

Column 13, 6th Heading, Table I, "Converter" should read -- Converted --;

Column 13, line 65, "60100" should read -- 60 100 --.

Column 14, line 4, "60100" should read -- 60 100 --.

Column 15, line 9, after "carbonates" insert -- , --.

Signed and Sealed this

Seventh Day of November 1978

[SEAL]

Attest:

RUTH C. MASON
*Attesting Officer*

DONALD W. BANNER
*Commissioner of Patents and Trademarks*